US010918196B1

(12) United States Patent
Stathis

(10) Patent No.: US 10,918,196 B1
(45) Date of Patent: Feb. 16, 2021

(54) MUDPAN BELT CLIP ASSEMBLY

(71) Applicant: Shark Toolers, Morris Plains, NJ (US)

(72) Inventor: James Stathis, Morris Plains, NJ (US)

(73) Assignee: Shark Toolers, Morris Plains, NJ (US)

( * ) Notice: Subject to any disclaimer, the term of this patent is extended or adjusted under 35 U.S.C. 154(b) by 0 days.

(21) Appl. No.: 16/778,243

(22) Filed: Jan. 31, 2020

(51) Int. Cl.

| | |
|---|---|
| ***A45F 5/00*** | (2006.01) |
| ***A45F 5/02*** | (2006.01) |
| ***E04F 21/02*** | (2006.01) |
| *B25H 3/02* | (2006.01) |

(52) U.S. Cl.
CPC ..... *A45F 5/021* (2013.01); *E04F 21/02* (2013.01); *A45F 2200/0566* (2013.01); *A45F 2200/0575* (2013.01); *B25H 3/02* (2013.01)

(58) Field of Classification Search
CPC .. F16B 2/20; F16B 12/32; A45F 5/021; A45F 2200/0575; A45F 2200/0566; E04F 21/02
USPC ..... 248/229.16, 316.7, 311.2
See application file for complete search history.

(56) References Cited

U.S. PATENT DOCUMENTS

| | | | | |
|---|---|---|---|---|
| 5,358,161 | A * | 10/1994 | Perugini | A45F 5/02 224/242 |
| 8,152,005 | B2 * | 4/2012 | Barkdoll | A47F 5/0025 211/88.01 |
| 2002/0020730 | A1 | 2/2002 | Baird | |
| 2004/0256433 | A1 * | 12/2004 | Baird | A45F 5/02 224/666 |
| 2011/0290803 | A1 * | 12/2011 | Kehres | E04G 21/005 220/475 |
| 2014/0319191 | A1 | 10/2014 | Wood | |

* cited by examiner

*Primary Examiner* — Steven M Marsh
(74) *Attorney, Agent, or Firm* — Jack Baldini, Esq.

(57) ABSTRACT

A simple, belt clip—mudpan combination to attach a joint compound, spackle, or mastic holding pan to a user's belt for free hand use of such pan, keeping the mudpan secure, stable, and at the ready for the user.

3 Claims, 14 Drawing Sheets

MUDPAN BELT CLIP ASSEMBLY

FIELD OF THE INVENTION

A simple, belt clip—mudpan combination to attach a joint compound, spackle, or mastic holding pan to a user's belt for free hand use of such pan, keeping the mudpan secure, stable, and at the ready for the user.

BACKGROUND

Constructing walls from drywall, or otherwise known as sheetrock, is a common building practice. This construction also involves spreading drywall compound, or otherwise known as spackle or mastic, at various places over the drywall, most typically, at joints or seams, over drywall tape, over nail heads, and essentially anywhere there is needed some smoothing out to provide a fully smooth, uniform, continuous surface to accept paint or other wall covering.

Drywall compound is a spreadable, gypsum based mud mixture, the consistency of soft clay or mud. It is typically spread with a trowel type tool, sometimes referred to as a drywall spackle knife or putty knife. Getting the compound or mud onto the knife or blade I generally accomplished by dipping the knife or blade into some larger container such as a pail or 'mudpan'. In some instances, some drywallers use a 'hawk' a device that essentially is a large flat surface supported by a handle. The installer places a large amount of compound on the flat surface and carries in one hand, and then transfers a smaller portion to the knife for spreading on the wall.

Some installers prefer hawks, and some prefer mudpans. There are pros and cons to each. The mudpan can typically carry more compound and is neater, but has generally thought to be more difficult to carry around. One convenience to a drywaller, is if the compound can be easily carried around with you without having to continually return to the master supply for a refill.

Overcoming the con with mudpans that they are more difficult and cumbersome to carry around is an object of this disclosure.

A mudpan is essentially a rectangular open box with welded edges to provide a sturdy, washable container to house drywall compound to be carried around by the drywall spackler to provide a supply of the drywall compound for ease of spreading and applying. However, a mudpan, when full of compound is heavy. Moreover, because of its shape, can be unstable to try and hold with one hand. There have been previous attempts to attach the mudpan via a clip to a user's belt.

For example, U.S. Patent Application Serial No. US 2002/0020730 A1, titled BELT MOUNTED MUD PAN HOLDER, discloses, "a clip having a portion for attachment to user's belt and a portion for holding a mud pan so that the mud pan is effectively hung via the clip from the user's belt." In this Application, the invention is described as, "a clip, which has two portions. One portion, the mud pan support portion, is configured to support a mud pan. The other portion, a belt attachment portion, is configured to attach to the user's belt. With the clip installed on the users belt and the pan supported, the user in effect carries the mud pan on his belt while he works." However, this disclosure fails to address how the weight of the pan, and the side to side sway is addressed to keep the pan stable on a user's belt.

Finally, in another example, U.S. Patent Application Serial No. US 2014/0319191 A1, titled SYSTEMS, DEVICES, AND/OR METHODS FOR MANAGING PASTES, discloses, "a clip, which has two portions. One portion, the mud pan support portion, is configured to support a mud pan. The other portion, a belt attachment portion, is configured to attach to the user's belt. With the clip installed on the users belt and the pan supported, the user in effect carries the mud pan on his belt while he works." In this reference, the slidability of the weight from side to side is addressed by a "curved brace" which can lay against a leg or hip, but nothing addresses supporting the weight specifically in an appropriately usable position, stable from sliding to and fro, and thus, fails to address the objects of the instant disclosure.

None of the foregoing references, alone or in combination, teach the salient and proprietary features or construction of the present disclosure, and as such, fail to be useful as a belt clip—mudpan support combination device.

The present disclosure teaches several embodiments that provide a proprietary belt clip designed to support an ordinary mudpan, but retrofitted with an assembly for accepting or mating with the proprietary belt clip, such belt clip comprising, a wide clip to provide stability, a positioning angled support to adjust the mudpan to the appropriate, substantially horizontal level position when worn on a user, and a lip for weight support, and further comprising a quick release mechanism to allow for easy refill.

SUMMARY

The present disclosure teaches embodiments that disclose a proprietary belt clip—mudpan with attached belt clip acceptance means combination, comprising, a proprietary belt clip, further comprising a wide stabilizing surface, generally ⅓ of the width of a mudpan, an angled support to correctly position an attached mudpan, a quick release mechanism comprising a slide through tab, and a tab weight support, with a chamfered end clip insertion point; and a mudpan, comprising an attachment configured to engage with said belt clip.

In one embodiment, the chamfered tip of the clip insertion point (8) makes the clip slip into the mudpan insertion means (2) extremely easy and as the clip then full inserts, the mudpan self stabilizes as the clip angles downward into the insertion loop.

In one embodiment, the chamfered tip of the belt clip (8) is angled inward (towards the wearer) and extends beyond the stabilizing plate (5) which enables easily catching the opening in a belt clip acceptance means on a mudpan, and then configured to guide the mudpan into position with a specialized gap between the actual belt clip tip (8) and the stabilizing plate (5), and angling down along an angled support (9) and onto a base support (10). See FIG. 8. Essentially, this design allows the mudpan to self-stabilize into position.

In one embodiment, the chamfered tip of the belt clip (8) easily finds a smooth outer surface of a stabilizing surface of the belt clip acceptance means on a mudpan (6), the angled nature of the tip then finding the insertion loop (7), and then the stabilizing surface of the belt clip acceptance means on a mudpan (6) and then slides along and rests against the corresponding stabilizing surface of the belt clip (5) to achieve an overall stability of the mudpan on the wearer. See FIG. 7. Again, this design allows a wearer to move and have the mudpan find its stable point during such movement.

In one embodiment, when clipped into place, the mudpan is stable with the corresponding stabilizing surfaces resting against each other. During use, the mudpan remains stable. However, when removal is desired, the belt clip has a quick release feature such that the entire mudpan and belt clip acceptance means can be easily lifted off of the belt clip when the wearer is moving on to another task, needs to re-fill, or just needs a break. At that point, except for the fact that it can be re-inserted onto a belt clip by virtue of having attached to it the belt clip acceptance means, it is essentially, and functions in all respects like, any other typical mudpan.

DETAILED DESCRIPTION

Figure 1:
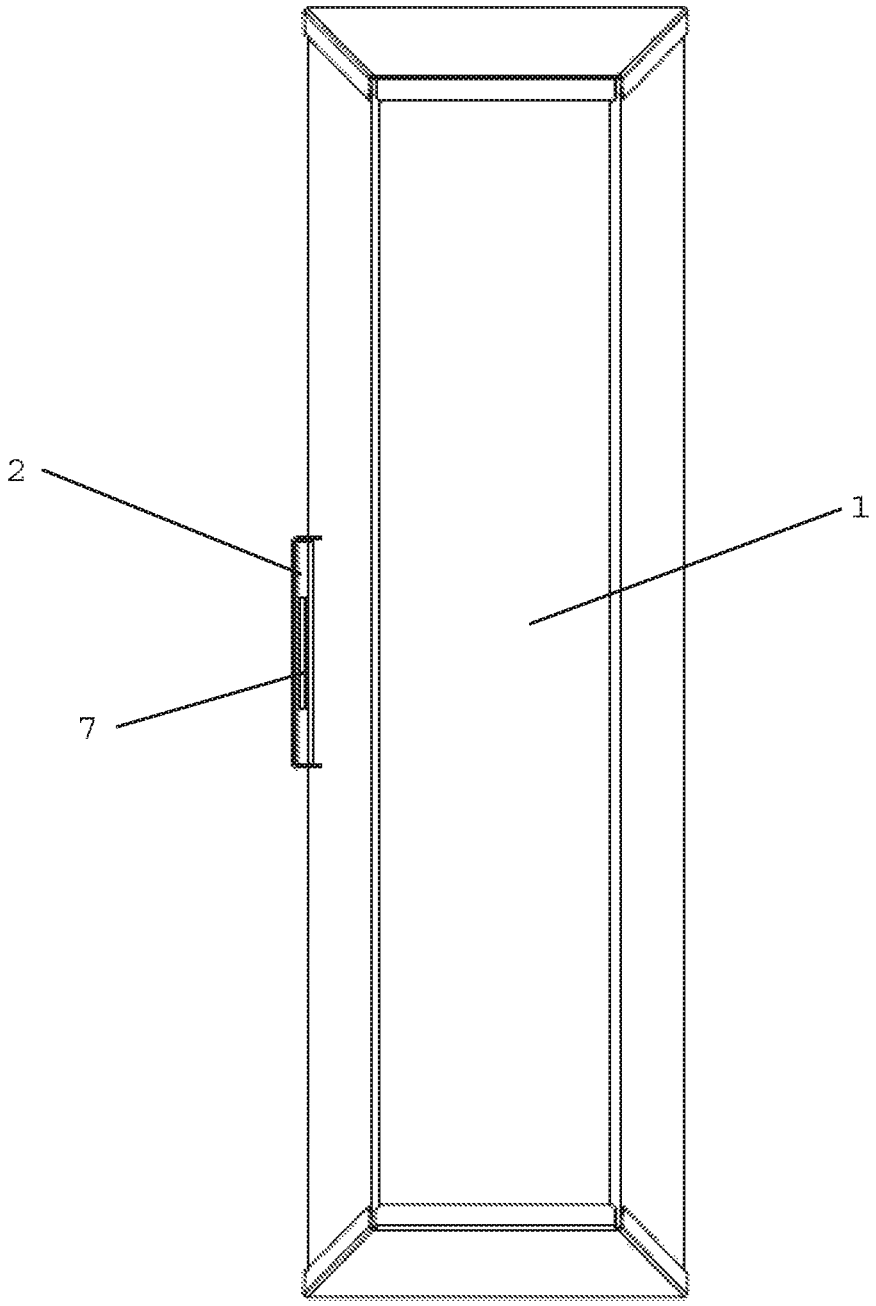
FIG. 1 depicts one embodiment of a typical mudpan (1), from an underneath view showing the outside walls, and a belt clip acceptance mechanism (2) which further comprises a smaller belt clip insertion loop (7).
Figure 2:
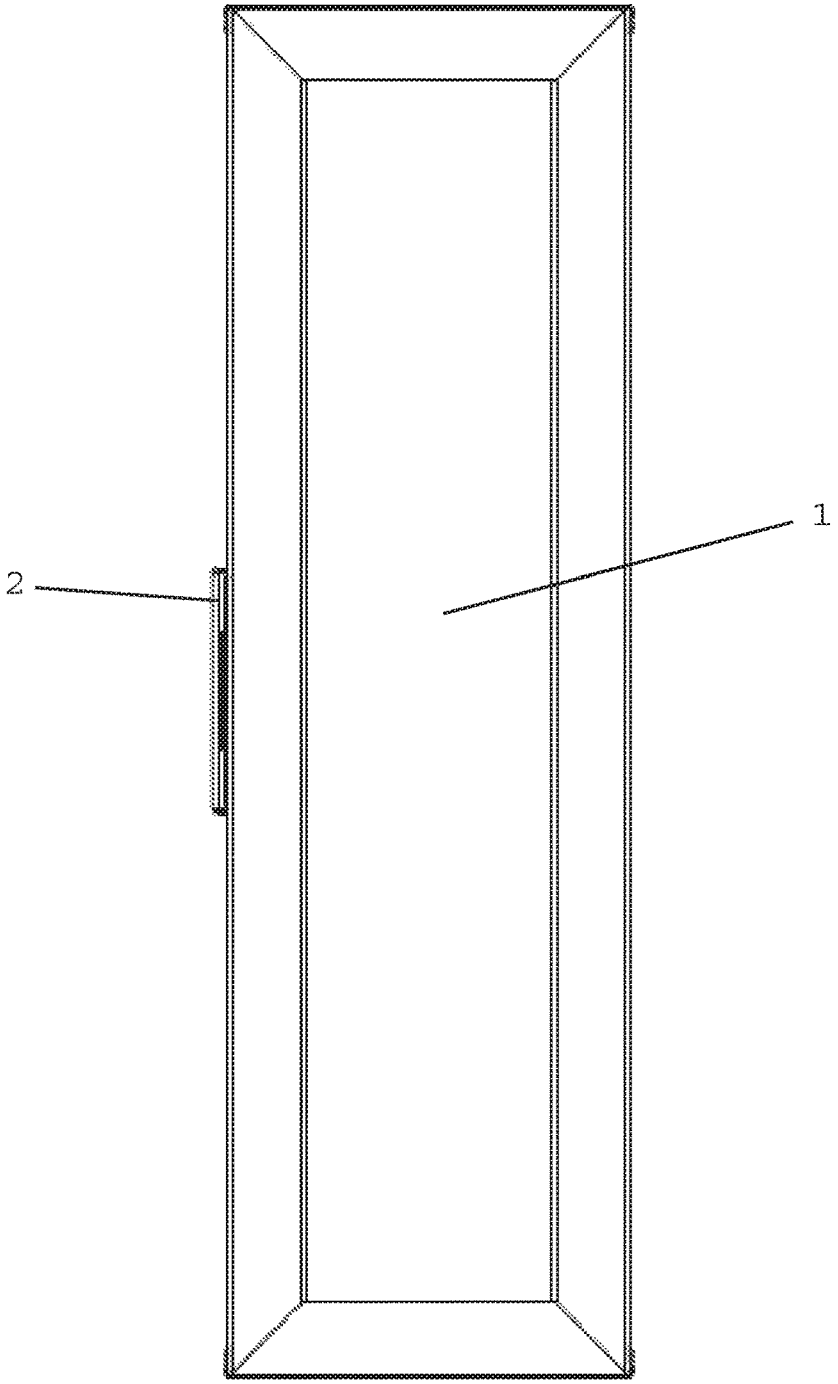
FIG. 2 depicts one embodiment of a typical mudpan (1), from an overhead view showing the inside walls, and a belt clip acceptance mechanism (2).
Figure 3:
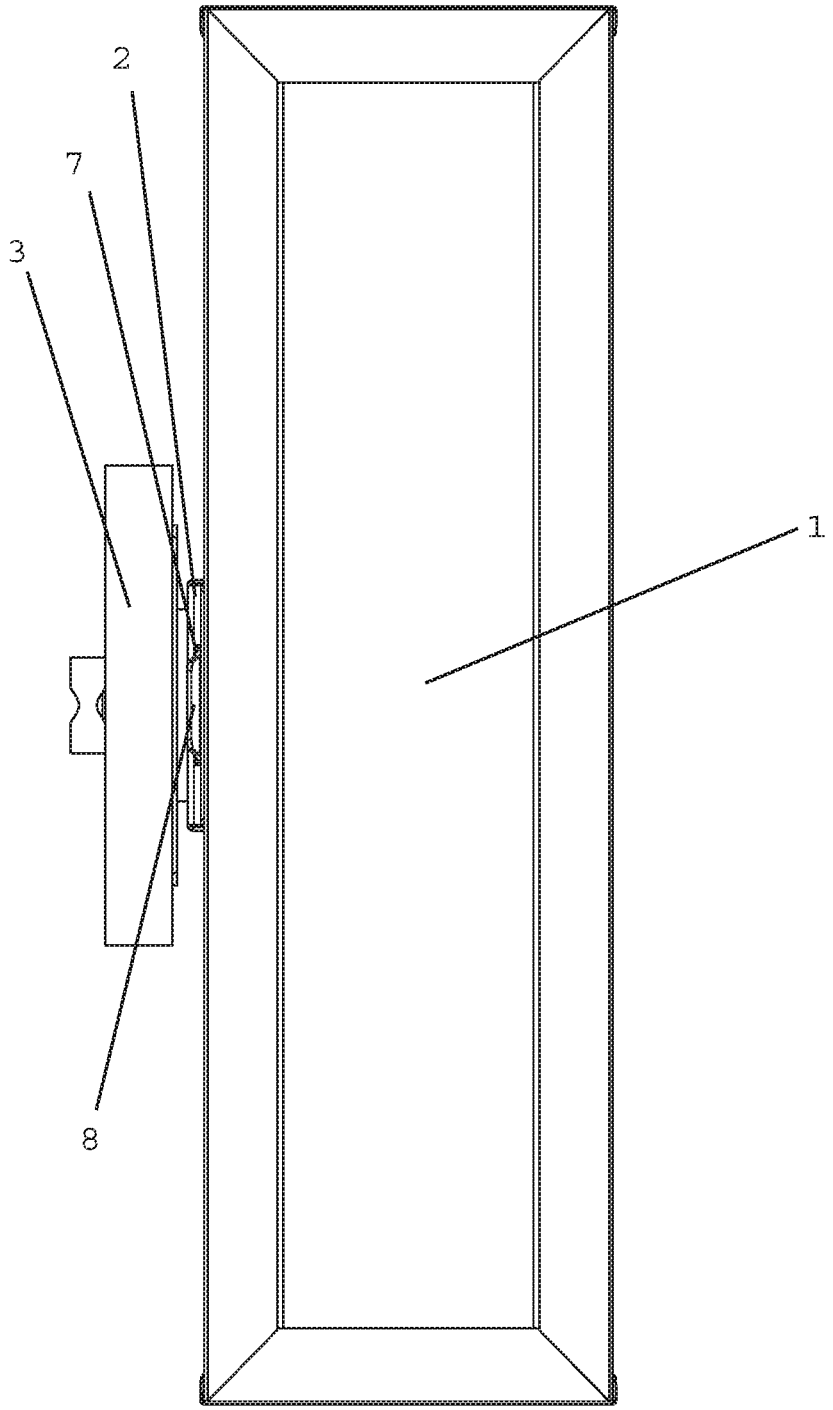
FIG. 3 depicts one embodiment of a typical mudpan (1), from an overhead view showing the inside walls, and a belt clip acceptance mechanism (2) with a belt clip insertion loop (7) having a chamfered tip (8) of a belt clip (3) inserted.
Figure 4:
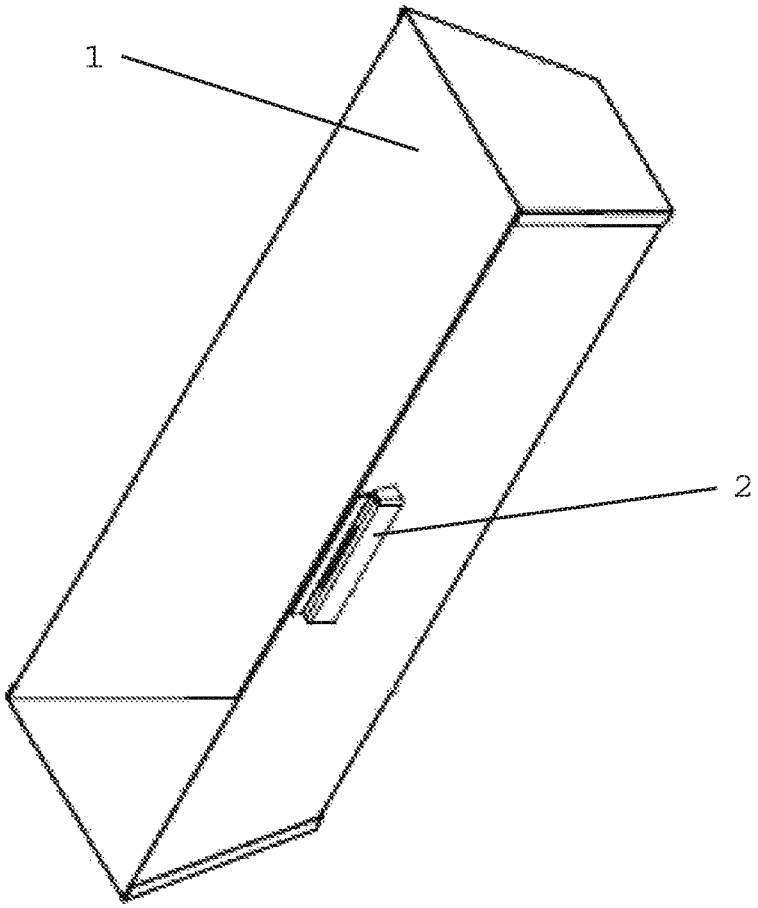
FIG. 4 depicts one embodiment of a typical mudpan (1), from a perspective view showing the inside walls, and a belt clip acceptance mechanism (2).
Figure 5:
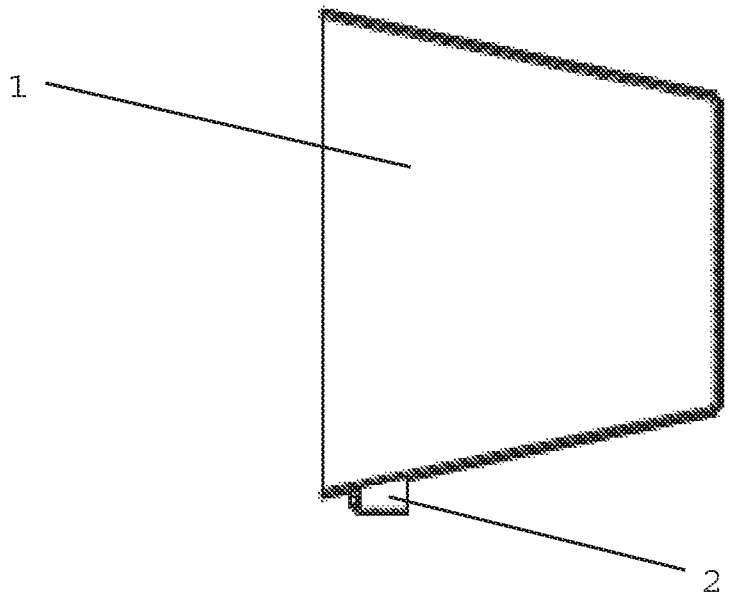
FIG. 5 depicts one embodiment of a typical mudpan (1), from a side view from one end showing the outside end wall, and a belt clip acceptance mechanism (2).
Figure 6:
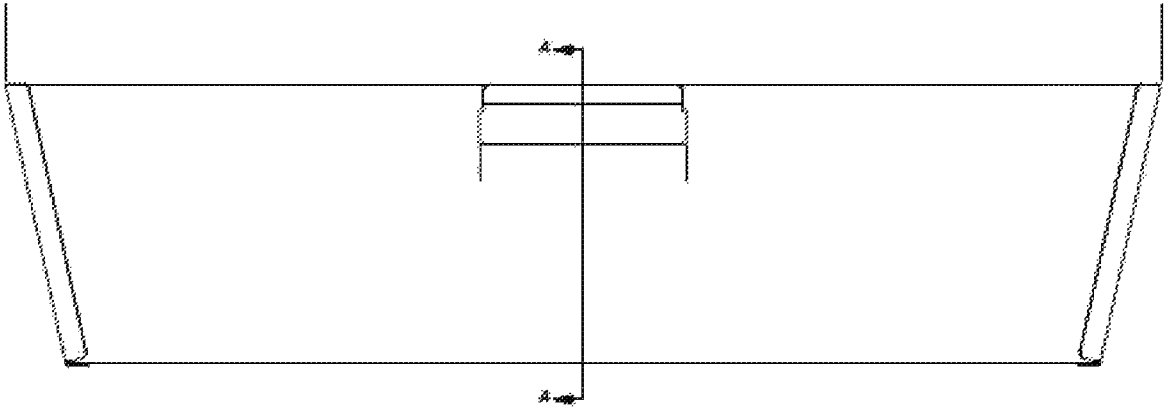
FIG. 6 depicts one embodiment of a typical mudpan in a cutaway view of a side wall comprising a belt clip acceptance mechanism and showing a pre-defined height of a mudpan that needs support.
Figure 7:
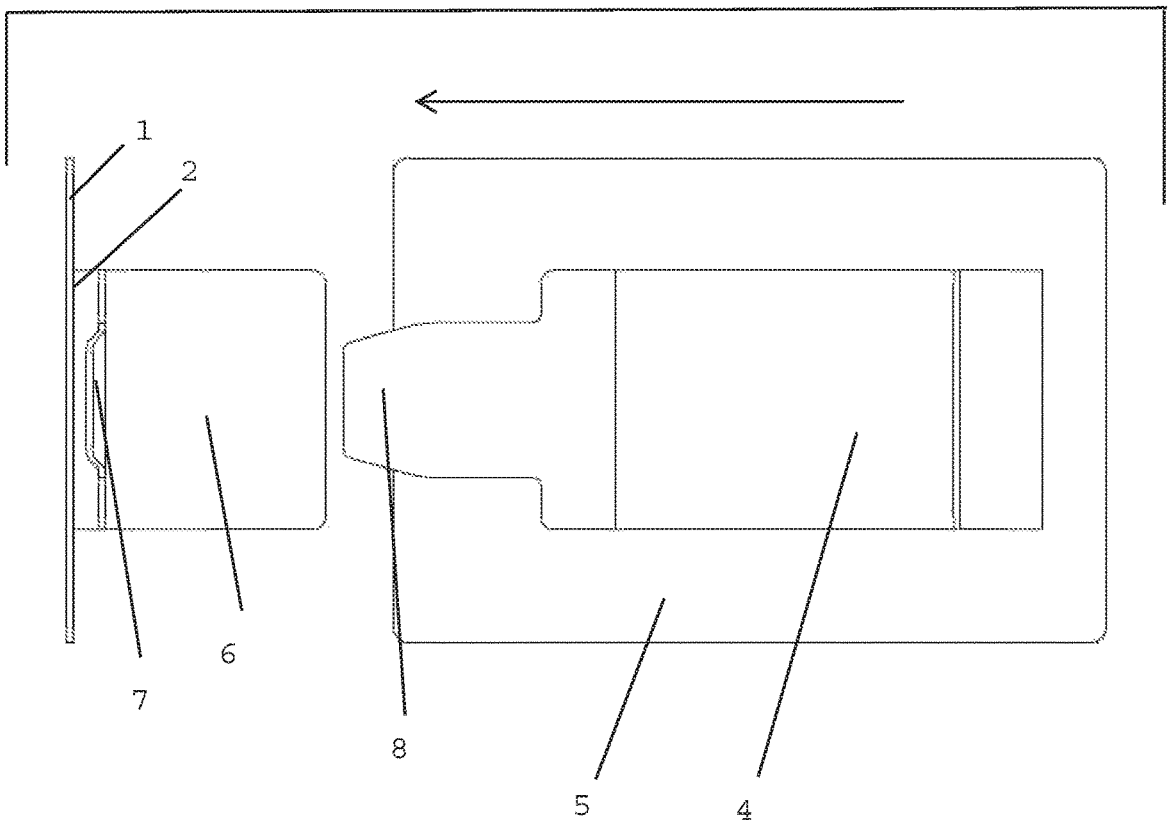
FIG. 7 depicts one embodiment of a belt clip acceptance mechanism (2) as would be attached to a mudpan (1) wall comprising a stabilizer surface (6) and a clip insertion loop (7) and one embodiment of a belt clip showing a stabilizing surface (5), a clip bonding plate (4) and clip insertion end with chamfered tip (8). Not easily seen in this view, but will become apparent in FIG. 8, this chamfered tip is also angled inward, towards the wearer or away from the corresponding stabilizing surface of the belt clip acceptance means.
Figure 8:
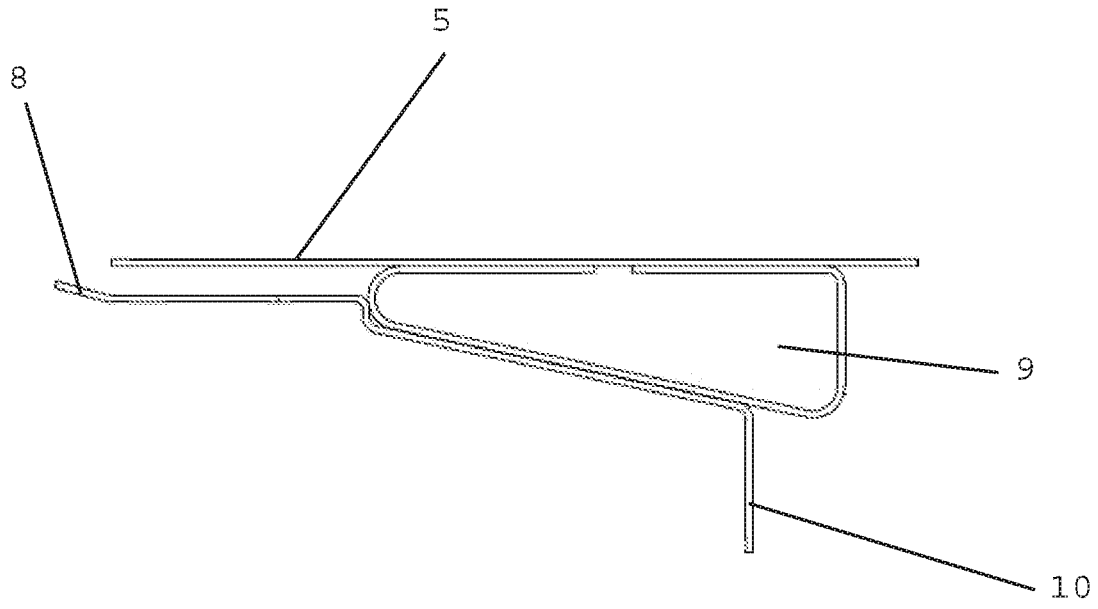
FIG. 8 depicts one embodiment of a belt clip showing a stabilizing surface (5), a chamfered clip insertion end (8), a mudpan bottom support (10) and an angled support (9).
Figure 9:
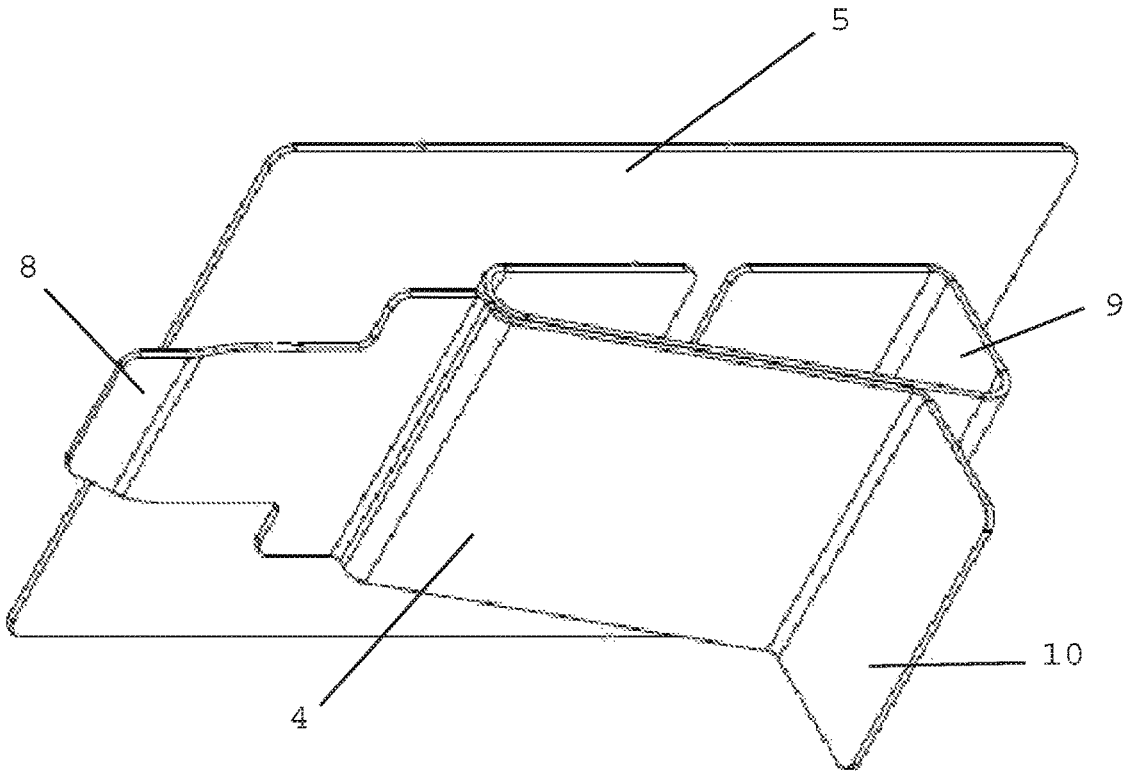
FIG. 9 depicts one embodiment of a belt clip in perspective view showing a stabilizing surface (5), a clip bonding plate (4), a chamfered clip insertion tip (8), a mudpan bottom support (10) and an angled support (9).
Figure 10:
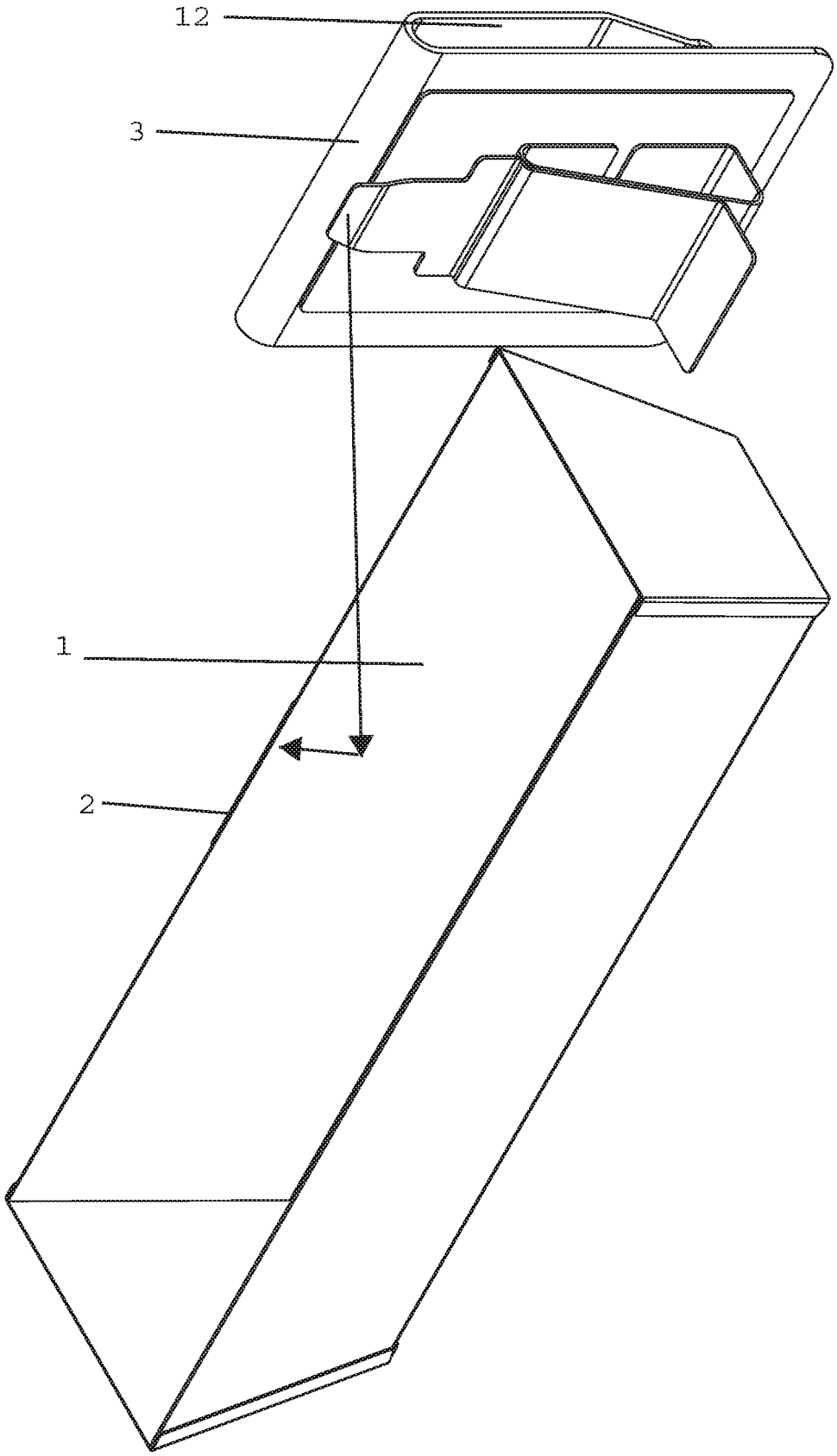
FIG. 10 depicts one embodiment of a typical mudpan (1) with a belt clip acceptance mechanism (2), oriented as it would nestle onto one embodiment of a belt clip (3) as described herein. The arrows indicate how the chamfered belt clip tip would move in relation to the mudpan to then get inserted into a clip insertion loop.
Figure 11:
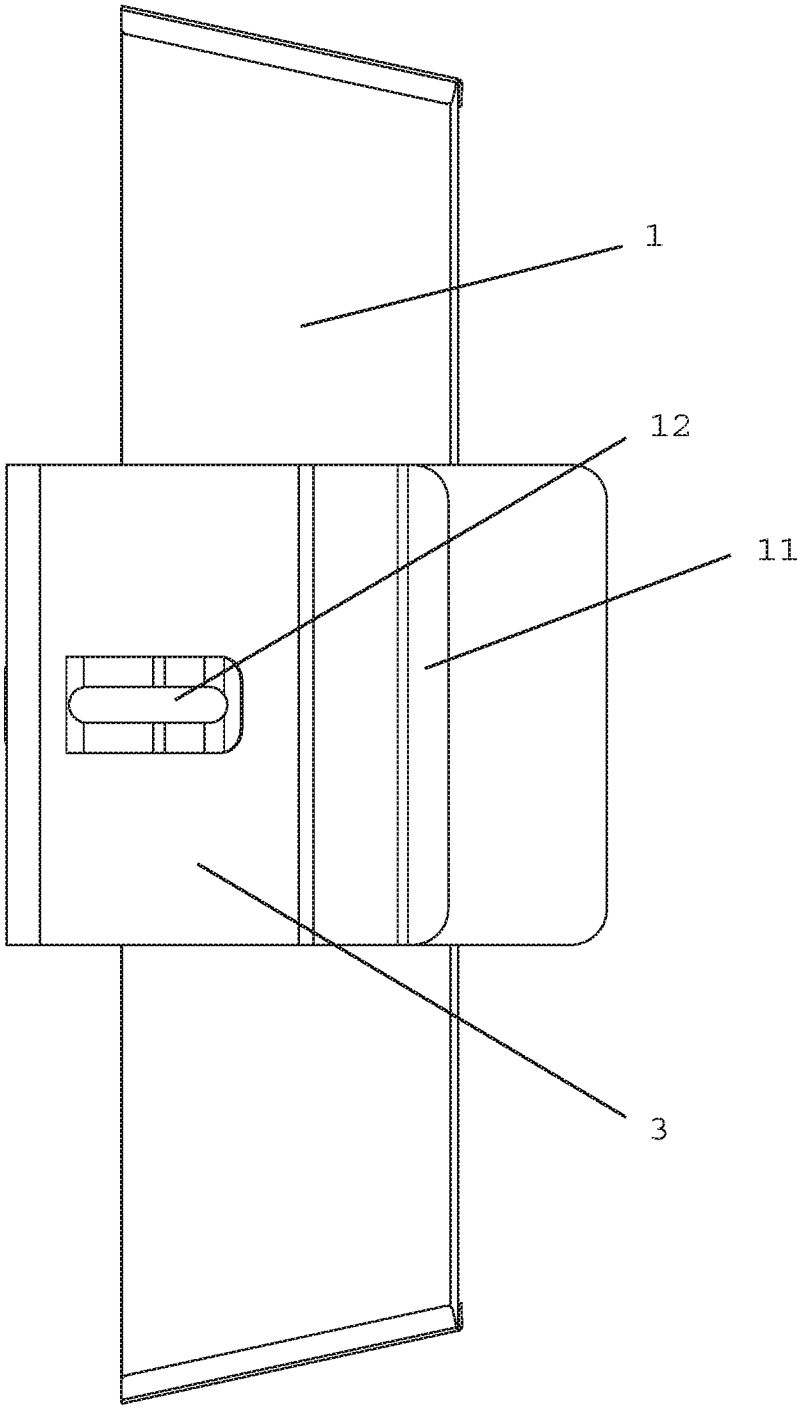
FIG. 11 depicts one embodiment of a typical mudpan (1) with belt clip (3) attached from a side view, ready to be attached to a user via a belt clip fastener, which can be large (11) or small (12).
Figure 12:
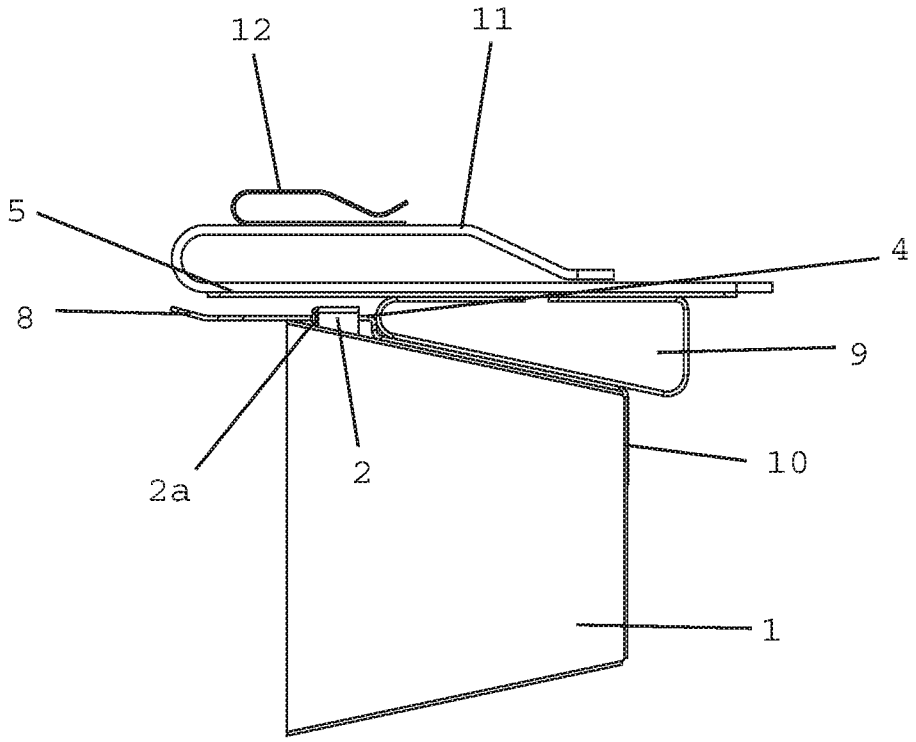
FIG. 12 depicts a side cutaway view of one embodiment of a belt clip as described herein comprising a stabilizing surface (5), a clip insertion end (8), a mudpan bottom support (10), an angled support (9), a clip bonding plate (4) with a large clip (11) and a small clip (12), attached to a mudpan (1) by insertion of the clip insertion end (8) through a belt clip attachment mechanism (2) attached to a mudpan having a quick release mechanism, such a spring (2*a*).
Figure 13:
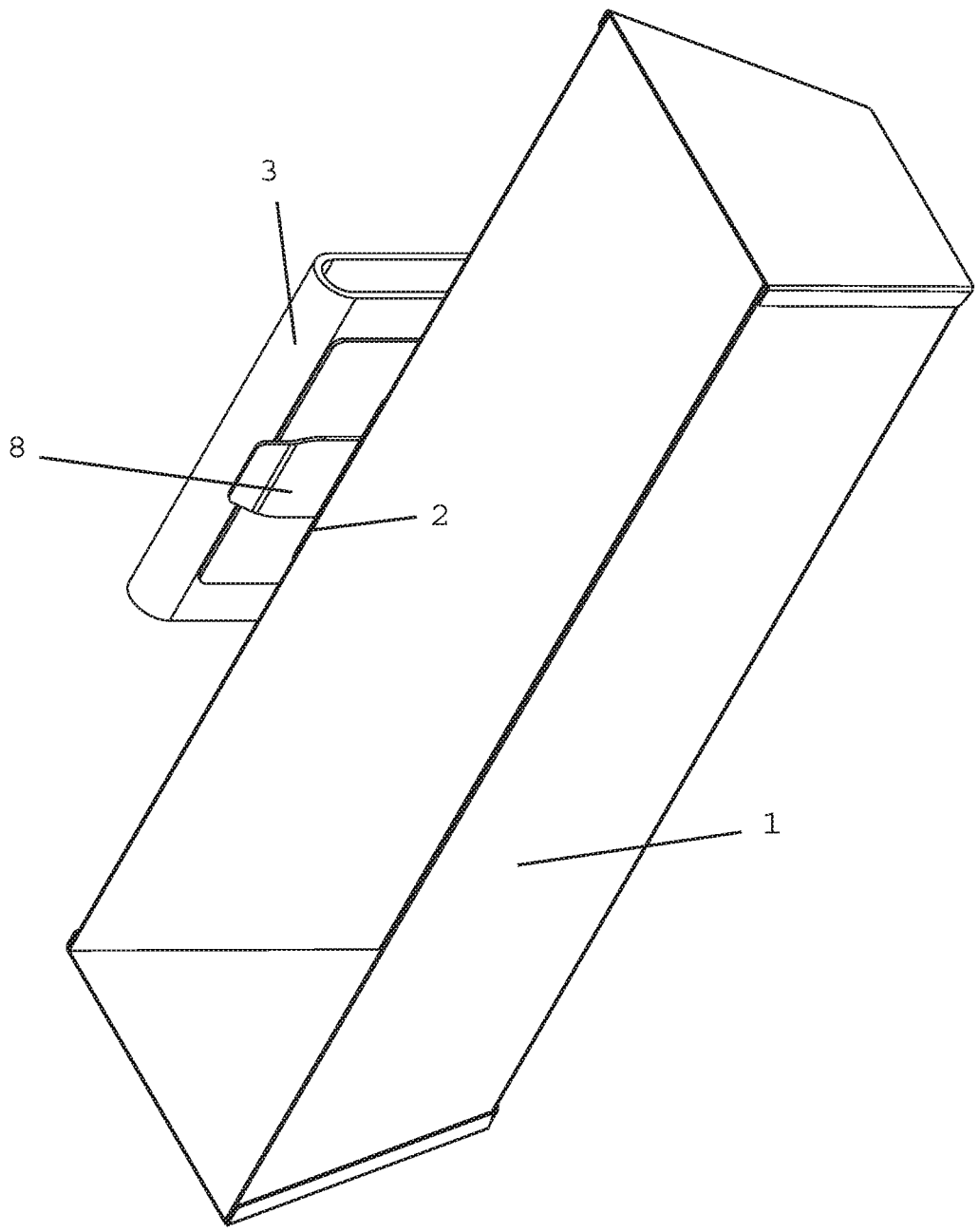
FIG. 13 depicts a perspective view of one embodiment of a belt clip (3) as described herein attached to a mudpan (1) by insertion of the clip insertion end (8) through a belt clip attachment mechanism (2) attached to a mudpan.
Figure 14:
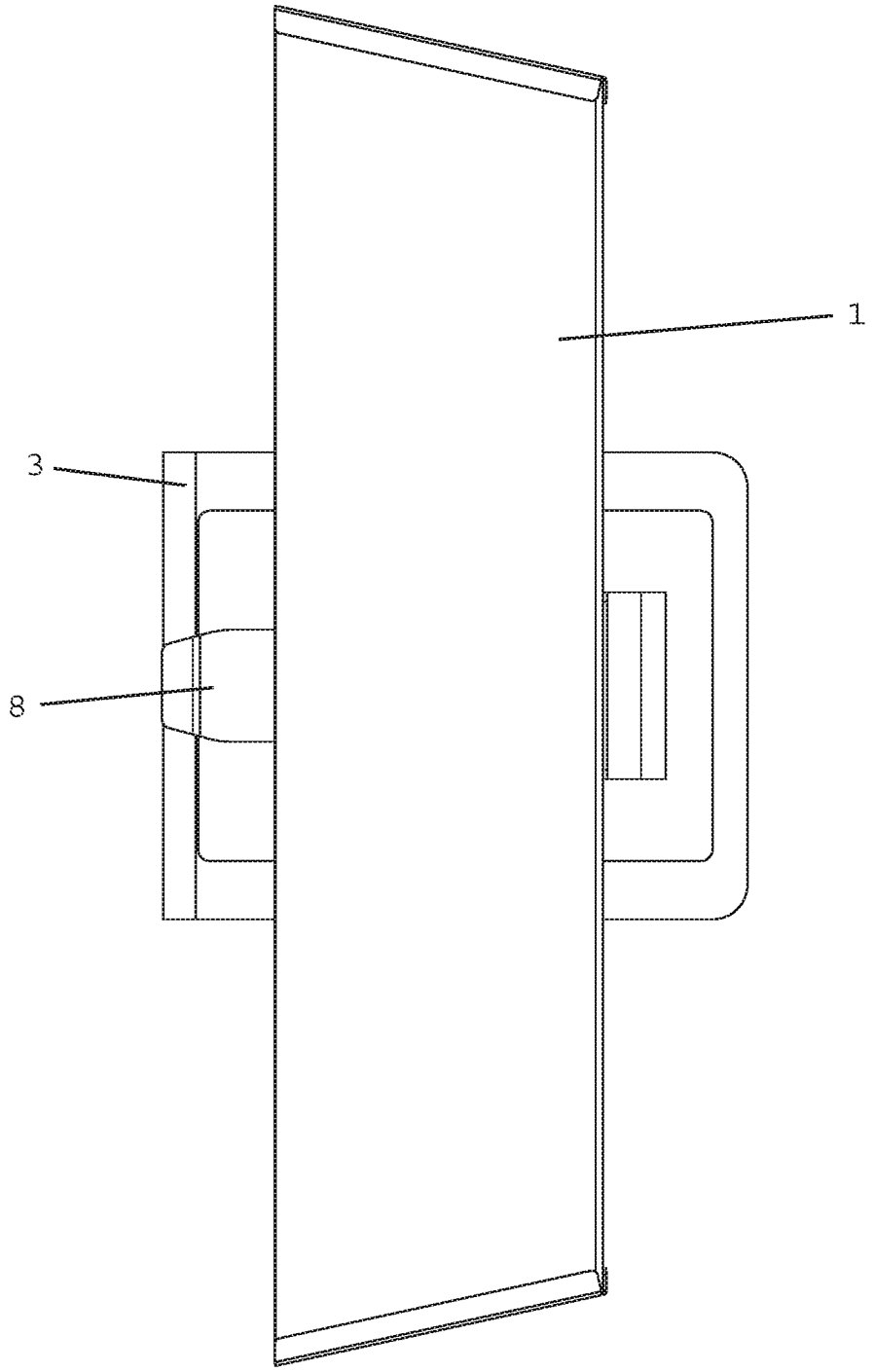
FIG. 14 depicts a side view from the outside of one embodiment of a belt clip (3) as described herein attached to a mudpan (1) by insertion of the clip insertion end (8) through a belt clip attachment mechanism (not visible) and depicting the various stabilizing elements.

For clarity of disclosure, and not by way of limitation, the detailed description of the invention is divided into the following subsections that describe or illustrate certain features, embodiments or applications of the present invention.

Definitions

"mudpan" as used herein means any substantially elongate, substantially rectangular container designed for temporarily containing tiler's grout or mastic or other soft, spreadable substance typically used by tillers during tile installation.

"belt clip" as used herein means a device for securing a mudpan to a wearer in a stable, secure manner, by having the device secure to both the mudpan and the belt or pants or other clothing worn by the intended wearer.

"chamfered" as used herein means a beveled or angled surface on an otherwise straight, solid edge.

The System and Method of the Present Invention

One embodiment of the proprietary belt clip—mudpan combination as described herein comprises a mudpan with an attached belt clip acceptance mechanism (3) that comprises a belt clip acceptance loop (7), a stabilizing plate (6), and a quick release mechanism; and a belt clip (3) that comprises a stabilizing surface (5), a clip bonding plate (4), a chamfered clip insertion tip (8), a mudpan bottom support (10), an angled support (9), and a mechanism for attaching the belt clip to a belt or other clothes of an intended wearer (11 [larger] or 12 [smaller]).

In one embodiment, the belt clip is molded from a solid one-piece plastic construction.

In one embodiment, the belt clip is made from metal and the various components welded together.

In one embodiment, the belt clip insertion tip (8) is both chamfered and angled in a manner configured to make the mudpan (1) easily attachable and detachable from the belt clip (3) as well as self-stabilizing by a juxtaposition of the corresponding stabilizing plates (5, 6). Typically, when items are attached to a belt clip and worn attached to the belt or pants of a wearer, the weight of the item pulls it away from the wearer. For example, when a cell phone is worn on a belt clip, the phone tends to pull away from the wearer, the top of the item pulling away and moving the bottom of the device inward. The heavier the item, the more this tends to happen. Thus, here, with a mudpan, which when full will be relatively heavier than things typically worn on a belt clip, this phenomenon would be accentuated. To counteract this effect, in addition to the stabilizing plates (5, 6) working to stabilize the mudpan from moving side-to-side, the angled support (9) pushes the bottom of the mudpan outward and prevents the top of the mudpan from tensioning outward. The degree of the angle is configured allow the mudpan, when worn on the belt clip as described, to be substantially horizontal. The bottom support (10) further supports the overall weight.

In one embodiment, a quick release mechanism (2*a*) is part of the belt clip loop (2) such that when the insertion tip (8) of a belt clip is inserted into the belt clip, it can be easily removed when desired. This may take the form of a simple friction device or a spring mechanism that holds the device in place as desired, but also allows for easy removal when desired.

EXAMPLES

The present invention is further illustrated, but not limited by, the following examples.

A typical use of the device combination as described herein is when a tile installer or a drywall installer has a need to spread drywall joint compound, tile mastic or grout. Normally, the worker will fill a mudpan with the substance and either carry it around or place it next to him and keep moving it. It is an object of this disclosure to provide a more convenient manner in which to have the mudpan in a convenient location, that is, by attaching it to the person of the installer. Previous attempts to attach a device such as this to a person has failed because of the weight of the mudpan when filled, as well as its elongate shape making a central connection point rendering the device unstable.

In embodiments as described, the weight and instability have been overcome by implementing a combination of corresponding stabilizing plates, an angled support and a bottom support. Additionally, by having a chamfered and angled insertion tip in the belt clip connection means, the mudpan settles into place and is self-stabilizing in the proper orientation. Also, the quick release mechanism provides the proper friction to keep the attachment clip from moving while also allowing it to be detached easily when desired.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. A belt clip—mudpan combination device comprising:

a mudpan further comprising an attached belt clip acceptance mechanism that further comprises a belt clip acceptance loop, a stabilizing plate, and a quick release mechanism; and a belt clip further comprising a stabilizing surface, a clip bonding plate, a rigid, substantially immoveable chamfered clip insertion tip, angled inward towards a user, a mudpan bottom support, an angled support, and a mechanism for attaching the belt clip to a belt or other clothes of an intended wearer.

2. The device of claim 1, wherein the belt clip is a solid one piece construction made of a plastic.

3. The device of claim 1, wherein the belt clip is made of metal.

* * * * *